US008291981B2

(12) United States Patent
Tveiten et al.

(10) Patent No.: US 8,291,981 B2
(45) Date of Patent: Oct. 23, 2012

(54) SHEAR OPEN VALVE

(75) Inventors: Magnar Tveiten, Sandnes (NO); Øyvind Stokka, Sandnes (NO); Erling Kleppa, Jørpeland (NO); Tom Norland, Hommersak (NO); Ole Sevheim, Stavanger (NO)

(73) Assignee: Petroleum Technology Company AS, Stavanger (NO)

( * ) Notice: Subject to any disclaimer, the term of this patent is extended or adjusted under 35 U.S.C. 154(b) by 203 days.

(21) Appl. No.: 12/676,916

(22) PCT Filed: Sep. 9, 2008

(86) PCT No.: PCT/NO2008/000320

§ 371 (c)(1),
(2), (4) Date: Apr. 28, 2010

(87) PCT Pub. No.: WO2009/038467

PCT Pub. Date: Mar. 26, 2009

(65) Prior Publication Data

US 2010/0288502 A1 Nov. 18, 2010

(30) Foreign Application Priority Data

Sep. 18, 2007 (NO) ..... 20074749

(51) Int. Cl.
*E21B 34/10* (2006.01)

(52) U.S. Cl. ..... 166/323; 166/321

(58) Field of Classification Search ..... 166/323, 166/321

See application file for complete search history.

(56) References Cited

U.S. PATENT DOCUMENTS

| | | | | |
|---|---|---|---|---|
| 2,982,226 | A | 5/1961 | Peters et al. | |
| 3,051,246 | A * | 8/1962 | Clark, Jr. et al. | 166/325 |
| 3,100,452 | A | 8/1963 | Grimmer et al. | |
| 3,192,869 | A | 7/1965 | McCarvell et al. | |
| 3,407,830 | A | 10/1968 | Reagan | |
| 3,776,250 | A | 12/1973 | Knox | |
| 3,957,114 | A * | 5/1976 | Streich | 166/285 |
| 4,064,937 | A | 12/1977 | Barrington | |
| 4,359,094 | A | 11/1982 | Risinger | |
| 4,420,044 | A | 12/1983 | Pullin et al. | |
| 4,445,571 | A | 5/1984 | Hushbeck | |
| 4,944,349 | A * | 7/1990 | Von Gonten, Jr. | 166/304 |

(Continued)

FOREIGN PATENT DOCUMENTS

| | | |
|---|---|---|
| GB | 2297822 | 8/1996 |

(Continued)

*Primary Examiner* — Nicole Coy
(74) *Attorney, Agent, or Firm* — Christian D. Abel

(57) ABSTRACT

The present invention regards a device designed for injection of fluids in a well bore, typically an offshore well bore for petroleum production and gas injection/gas lift system for fluid injection. The device comprises a outer hollow housing with an internal body moveable within the outer housing which in a first closed position is closed with a metal to metal seal system between the outer housing and the internal body, which internal body is operated by pressure differential across the internal body. The internal movable body is connected to the outer hollow housing by means of a retainer key. The retainer key comprises a shear arrangement and is arranged to keep the valve in a fixed closed position, where fluid pressure is to overcome the pretension of the retainer key in order to open the device. When the device is shear opened, it can be kept in this open position as the retainer key is locked to the outer hollow housing.

7 Claims, 1 Drawing Sheet

U.S. PATENT DOCUMENTS

| | | | | |
|---|---|---|---|---|
| 5,141,056 | A * | 8/1992 | Tailby | 166/318 |
| 6,666,273 | B2 * | 12/2003 | Laurel | 166/382 |
| 7,213,607 | B2 | 5/2007 | De Almeida | |
| 2003/0098163 | A1 * | 5/2003 | Hebert et al. | 166/381 |

FOREIGN PATENT DOCUMENTS

| | | |
|---|---|---|
| NO | 321741 | 6/2002 |
| WO | WO 2005/052313 | 6/2005 |
| WO | WO 2007/084006 | 7/2007 |

* cited by examiner

SHEAR OPEN VALVE

CROSS REFERENCE TO RELATED APPLICATIONS

This application is a National Stage application of PCT/NO2008/000320, filed Sep. 9, 2008.

FIELD OF THE INVENTION

The present invention relates to devices typically used in connection with downhole tools in gas and oil offshore or onshore wells and in particular though not exclusively, to a fluid injection valve. The device may also, as a separate unit, be used to control a flow of fluid between an outside and inside of a tubular member in offshore or onshore wells.

BACKGROUND OF THE INVENTION

Hydrocarbon fluids, such as oil and gas and or mixtures of these, are normally found in accumulations under pressure in the subsurface in porous formations. These hydrocarbons are obtained from the formations through the means of boring of wells that penetrates the strata that protects the formation.

In order to exploit such natural reservoirs of hydrocarbons, one or more bores are typically drilled in the ground from a position on the ground surface. Processing installations on or above the ground surface, which then in different ways are able to communicate with the reservoir, are further adapted to collect and treat the produced fluids.

Natural pressure in the reservoir acts to lift the produced fluids upward to the surface through a production tubing. The reservoir pressure must in this case exceed the hydrostatic pressure of the fluid in the well bore and back-pressure imposed by the production facilities at the surface for the well to produce naturally.

However, the natural pressure in a well will gradually decrease as the well is run, whereby this entail a smaller amount of produced fluids. This bring about a need to either increase the pressure in the fluid reservoir again, or in other ways to enhance the production of fluids. The basic idea for all such methods and/or devices is to drive more hydrocarbons out of the reservoir.

When an external source of energy is employed in the well, for example a pump, the well is said to produce by means of an artificial lifting. The two most common used systems today are however water injection and gas injection. The gas injection method is also known as pneumatic lifting or pneumatic pumping.

In common configuration utilised in this gas injection method, natural gas under high pressure is injected into the annular space between the casing and the production tubing. The gas injection devices, for instance valves, control subsequently the flow of gas that discharges from the annular space to the interior of the production tubing.

Depending on the properties of the well, one or more of gas injection valves are positioned at different locations along the length of the production tubing. When the pressurised gas enters the production tubing, it will expand and the consequential reduction in the density of the production flow will permit an increased flow of fluids.

There are known several different principles of operating a gas injection valve, one of this is based on the Venturi principles, for instance as described in WO 2004/092537 A1. Here a mandrel for a gas lift valve comprises an elongated member provided with means of connection at its ends. The body is provided with a side pocket and a side receptacle in the interior of which may be housed a gas lift valve that injects gas into the interior of the body of the mandrel by means of orifices positioned in a nose.

These gas injection valves may also, although their primary task is to be utilized as gas injectors, serve for chemical injection in the well. Furthermore, they may be produced in order to function as differential operating gas lift valves, shear open valves, dump/kill valves etc.

The purpose and specific approach of this invention is to provide a valve where the intention is to shear open the valve where the valve subsequently functions as a normal injection valve. The valve can also function as a dump/kill valve where the purpose of the valve is to shear open and thereafter be kept in this position.

Known in the art are valves for instance shown in GB 2.424.438 and U.S. Pat. No. 6,102,126.

GB 2.424.438 describes a valve for use in a downhole tool, where the valve has an inlet communicating with the work string from which it is anchored. The inlet provides a flow path of a first cross-sectional area. A sealing assembly comprising a spring biased seal cap moves within an outer tubular body to open and close a number of ports arranged through the body. The ports provide a flow path of a combined cross-sectional area greater than the first cross-sectional area and the valve is arranged such that the fluid flow through the inlet moves the seal cap to open the valve and create an unimpeded flow path between the inlet and the ports. These examples are utilizing pressure shear out systems but have experienced low efficiency reliability in respect of operation and shear out force. Therefore the need for a more reliable system and design has revealed the present invention.

GB 2.297.822 describes valves for use in inflatable packers in a well bore, and more particularly, to a system for utilizing a pressure limit valve with an inflatable packer or with closely coupled inflatable packers, for controlling pressure differentials to prevent malfunction of an inflatable packer in a well bore. The valve comprises a valve member, which normally seats on a seat and is spring biased to the closed position. A valve cap comprises a bore through which a valve stem can pass. The stem is held in the valve-shut position by a frangible pin. When a preset pressure in the bore is reached, the pin breaks permitting the valve to open and vent through the bore. After venting the spring shuts the valve and collets which are biased into contact with the stem contact an abutment preventing the valve from reopening.

U.S. Pat. No. 3,776,250 describes a valve collar for allowing a pipe string to fill up as it is lowered in a bore hole, while controlling the rate of fill up through a differential fill feature, utilizes a valve plunger in a valve body with the plunger opening against spring means and having an elastomeric collar intermediately occur above a predetermined differential pressure.

U.S. Pat. No. 3,407,830 describes gas lift valves for controlling the admission of gas or air into a column of fluid in a well to lift the column and to aid in flowing the fluid from the well.

SUMMARY OF THE INVENTION

Accordingly, an aim with the present invention is to provide a more efficient device in order to control the injection of fluids into a production tubing.

It will be yet another aim of the present invention to provide a gas injection device having a high straight flow area.

Another aim of the present invention is to provide a device that can be used together with downhole tools or as a separate unit.

It will be an object of the present invention to provide a device where the pretensioning of the device is adjusted in a simply manner.

Yet another aim of the present invention is to provide a device with a true metal to metal sealing of the device.

It is also an aim of the present invention to provide a device with a shear open arrangement that is not threatening to harm or inflict on the sealing surface during and after shear out.

Another aim of the present invention is to provide a device with a shear out arrangement positioned preferably outside the gas lift valve sealing capabilities on the tubing side.

It is also an object of at least one embodiment of the present invention to provide a device that overcomes at least some of the disadvantages of prior art valves. There is a further aim to provide a shear open device that will avoid inflicting on the valve functions as flow restrictions and disturbances in the injection flow, giving reduced pressure losses across the device.

These objectives and aims are achieved with a gas injection device according to the invention as defined in the enclosed independent claim, where embodiments of the invention are given in independent claims.

The present invention is intended to enable a safer and better device designed for control and injection of fluids in a well bore, typically an offshore well bore for petroleum production and gas injection/gas lift system for fluid injection. The device may also be used for injection of other constituents such as well stimulation fluids, cutting injection, water injection, kill mud, etc.

A gas lift valve according to a first embodiment of the present invention will act as a barrier element between annulus and production tubing (this is referred to as a safe closed position), where the valve at a desired stage is exposed for a pressurized fluid. This pressurized fluid will, if a predetermined pressure is exceeded, break the preset closing arrangement of the valve, thereby opening for the injection of fluid into the production tubing. After breaking the closing arrangement, the valve is to act as a regular gas lift valve.

In a second embodiment the intention of the valve is to act as a barrier element between annulus and tubing (safe closed) and at a desired stage the valve is pressurized open with an injection fluid and the preset closing arrangement of the valve is sheared open. After opening the intention of the valve is to keep open at all time.

The device according to the invention comprises an outer hollow housing and an internal body movable in a longitudinal direction within the hollow housing. The internal body will be restricted in its movements by a stop surface arranged in the nose of the outer hollow housing and an interior stop surface formed on the outer hollow housing inner surface, located on the opposite end of the nose. As is to be understood, the outer hollow housing may be manufactured in one unit, or it may alternatively comprise several parts, for instance a main part and a corresponding nose. When the device is in a closed position, a pressure surface of the internal movable body is abutting against the interior valve seat surface of the outer hollow housing thereby forming a metal to metal seal system between the outer hollow housing and the internal movable body.

The valve is operated by a pressure differential that is generated across the internal movable body. Exposing the surfaces of the internal movable body to different fluids can create this pressure differential. For instance, well fluids may act on at least one surface of the internal movable body in order to activate the device, or it can be injection fluids acting on one side of the internal moving body while well fluid is acting on opposite surfaces of the internal movable body. It may also be other combinations.

According to an aspect of the present invention the pressure differential across the internal body may be assisted by at least one predetermined pressure balanced elastic element to open and close the device.

The seal system comprises a valve seat, which valve seat also will function as a stop surface for the internal movable body, in the outer housing and a valve element sealing surface on the internal body. This valve element sealing surface will in an open position of the device be positioned mainly outside the injection fluid stream. With open position one should in this description understand a position wherein the internal movable body is abutting the stop surface arranged in the nose of the valve, and where the valve element sealing surface has moved past at least one outlet in the outer hollow housing, thereby opening for the fluid to be injected into the production tubing to pass through the valve.

According to another aspect of the present invention the internal body comprises a stop surface which in a fully open position of the device is abutting against a corresponding surface (the nose) in the outer housing. This stop surface may be positioned on one end of the internal body close to the outlet of the device, preferably on an opposite side of the slots compared with an inlet for the injection fluid into the intended bore and thereby prevent vibration in the internal body of the injection fluid, in an open position of the device.

When the device is in a closed position, the internal movable body is held against the valve seat of the outer hollow housing. In this position it is formed a metal to metal sealing between the outer hollow housing and the internal movable body, where the closed position is obtained by means of a retainer key being arranged between the internal movable body and the nose of the outer hollow housing. This arrangement will force the internal movable body in a tight abutment with the valve seat and further restrict the internal movable body to move against an open position as long as the pressure on the opposite side of the body is less than a predetermined value.

The device according to the present invention also includes a shear arrangement, where this shear arrangement comprises a retainer key. The retainer key may be connected to the inside of the outer hollow housing and held in its position by using a shear pin, shear sleeve, shear plate etc. The retainer key may furthermore preferably be preinstalled in the outer hollow housing by means of fastening devices, such as threads, bolts, pins or other means of clamping.

The outer hollow housing will in its nose be arranged with a through-going opening this allowing the retainer key to slide through the opening thereby moving to the outside of the device when the device is shear opened. The retainer key will also include at least one set of locking means, where these locking means in a shear opened position of the valve will prevent the retainer key to "fall" out of the valve.

The locking means may for instance be shear pins, shear sleeves, shear plates, locking rings etc., where these will cooperate with corresponding locking means in the nose of the valve.

In one embodiment of the invention the shear arrangement may be adjusted to fit the conditions of the well where the device is to be used. This will give that, by using a screw nut or a counter nut, the shear pin, shear sleeve etc may be fastened to the outer hollow housing. By screwing or unscrewing the screw nut containing the shear arrangement, both the position and pre tensioning of the shear pin, shear sleeve etc may be accomplished. For instance, if one knows that a pressure in a specific well is low, one could screw the screw nut far into the outer hollow housing thereby pressing the internal movable body against the valve seat even more, while this simultaneously will weaken the shear arrangement. When the valve then is exposed to the pressurized fluid from the annulus, it will shear open quite easy.

In the same way the pre tensioning and pre setting of the retainer key may be obtained. A section of the outer hollow housing may be treaded or bolted in order to be adjusted in a correct position for obtaining the pre tension of the retainer key. The retainer key may be connected to the internal movable body either temporary or permanently. The latter is preferred as the retainer key is equipped with suitable means for connecting the retainer key and the internal movable body to the outer hollow housing, thereby obtaining that the valve will be kept in an open position. In one embodiment of the present invention this adjustment may for instance be done by the nose. The outer surface of the nose, as the nose then is a separate part, is then arranged with threads while it further in conjunction with the through-going opening is formed a partial threaded recess. A holding device, comprising threads on its outer circumference, is then screwed into the partial recess in the nose. The holding device comprises further a through-going opening or bore that corresponds with the opening in the nose, through which openings the retainer key will be able to pass through. In order to hold the retainer key temporarily in position, the holding device will also include locking means inside its opening, where this for instance may be a graduation, a pin or bolt or similar. The retainer key may have complementary locking means. When the shear arrangement is to be set to a certain well and the conditions there, the retainer key is first screwed into the holding device. The holding device with the retainer key is then screwed into the recess of the nose, where the position of the retainer key then can be adjusted and set. As a last operation, the nose together with the holding device and the retainer key is screwed to the outer hollow housing; by screwing the nose further in onto the outer hollow housing, the retainer key will be guided towards the internal movable body. By arranging the valve as described above, the valve may be adjusted to open at a predetermined pressure, where the valve further may be left in a constant open position, or it can be closed when the pressure diminish.

With the valve according to the present invention it is also achieved a valve where the valve cannot open before a certain predetermined pressure is breaking the shear mechanism, even if the valve itself could have open at a lower pressure that the predetermined pressure.

BRIEF DESCRIPTION OF THE DRAWINGS

The foregoing and other objects, features and advantages of the invention will be apparent from the following more particular description of preferred non-limiting embodiments of the invention, as illustrated in the accompanying drawings, where.

DETAILED DESCRIPTION OF THE INVENTION

Figure 1:
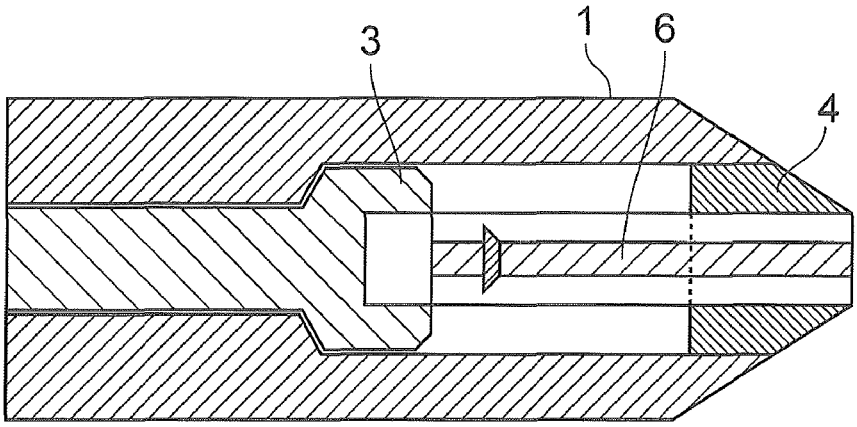
FIG. 1 shows a cross section with the main parts of the device according to the present invention.

While the invention is subject of various modifications and alternative forms, specific embodiments have been shown by way of example in the drawings and will be described in detail herein. The drawings are further not necessarily in scale and the proportions of certain parts have been exaggerated to better illustrate particular details of the present invention.

In the description that follows, like part are marked throughout the specification and drawings with the same reference numerals, respectively.

In the figures are shown different embodiments of a gas lift valve, where the valve is to be positioned in a well stream. A skilled person will understand how this is done and this is therefore not described in this description.

Referring now to FIG. 1, the main parts of a device according to the present invention is shown. The device is shown as a gas lift shear valve and comprises an outer hollow housing 1, in which hollow housing 1 is arranged an internal movable body 3. The outer hollow housing 1 in this embodiment comprises two parts, that is, the main part 1 and a pre tensioning section 4. The device in the figure is shown in a closed position and the internal movable body 3 is therefore abutting against a valve seat 2 (see FIG. 2) in the outer hollow housing 1. A retainer key 6 is arranged between the pre tensioning section 4 and the internal movable body 3, pressing the internal movable body 3 against the valve seat 2, thereby forming a metal to metal seal system between the outer hollow housing 1 and the internal movable body 3. This is because the internal movable body 3 comprises a valve element sealing surface 9. Although the device normally is used as a gas lift valve, it is obvious that the principle of it may be used for other kind of injection valves.

Figure 2:
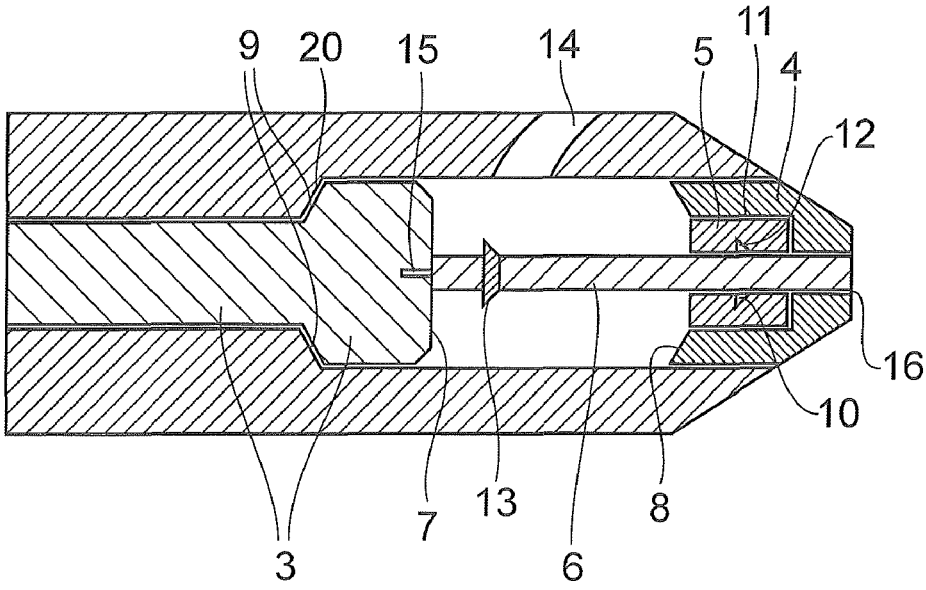
FIG. 2 shows a cross section of one embodiment of the present invention.

In FIG. 2 is shown a more detailed embodiment of the present invention. The pre tensioning section 4 which forms the nose of the outer hollow housing 1 is connected to the outer hollow housing 1 by the means of threads (not shown). This will give the opportunity to adjust the position and or the pre tension on the retainer key 6, in a way that is to be explained later in the description. This pre tensioning section 4 is on its side being inside the outer hollow housing 4, formed with a partial recess 11, where the inner periphery of the recess 11 are arranged with threads. A bore 16 stretches through the partial recess 11 and the pre tensioning section 4, thereby allowing the retainer key 6 to move through the bore 16 and outside of the valve when the valve is shear opened.

A screw nut or a counter screw nut 5, which also have a through going bore 16, is screw in into engagement with the partial recess 11. The screw nut or counter screw nut 5 has on the inside of the bore 16 arranged locking means 12 for locking the retainer key 6 temporary to the outer housing 1. The locking means 12 may in the screw nut or counter screw nut 5 be a graduation, in which graduation the first set of corresponding locking means 10 on the retainer key 6 are received. This position will correspond to the valve being in a closed position. However, when the valve is exposed for a pressure that exceeds the predetermined pressure for the valve, the first set of locking means 10 on the retainer key 6 being in the graduation 12 will break and thereby allowing the internal movable body 3 and the retainer key 6 to move towards the pre tensioning section 4.

As the retainer key 6 is connected to the internal movable body 3, they will move together as one unit, whereby a second set of locking means 13 on the retainer key 6 eventually will reach the graduation 12 in the screw nut or counter screw nut 5 and be stopped in this graduation 12. The second set of locking means 13 on the retainer key 6 are placed near the end of the retainer key 6 that is in contact with the internal movable body 3. The positioning of the second set of locking means 13 on the retainer key 6 is of importance as the pre tensioning section 4 on its side that face the internal movable body 3 is arranged with a stop surface 8. This cavity is to receive a corresponding stop surface 7 on the internal movable body 3. When the stop surfaces 7, 8 on the internal movable body 3 and the pre tensioning section 4 of the outer hollow housing are abutting each other, the second set of locking means 10 on the retainer key 6 will be received in the graduation 12 in the screw nut 5. This will result in that the valve may be locked in this position.

The first set of locking means 10 on the retainer key 6 may be shear pins shear sleeves, shear plates, while the second set of locking means 13 may be a locking ring or similar. The second set of locking means 13 will when the device is shear opened secure the retainer key 6 to the pre tensioning section 4 as the second set of locking means 13 through the movement of the internal movable body 3 and the retainer key 6 will be received in the graduation 12 in the screw nut 5, thereby preventing that the retainer key 6 is "falling" out from the device. These locking means 12 may for instance be shear pins, shear sleeves, shear plates, locking rings etc.

The retainer key 6 and the internal movable body 3 are connected to each other by an anchoring device, where a positioning pin 15 on the end of the retainer key 6 is guided into a hole in the internal movable body 3 and thereafter bonded together. The outer hollow housing 1 will comprise an interior valve seat 2, where this seat is positioned on the opposite side of the pre tensioning section 4 of the outer hollow housing 1. The internal movable body 3 will abut against this valve seat 2 when the gas lift valve is in a closed position. The internal movable body 3 is prevented in moving against the pre tensioning section 4 and an open position, as the retainer key 6 is pressing the internal movable body 3 to form a metal to metal sealing against the valve seat 2.

Furthermore, since the retainer key 6 in one end through the screw nut 5 is connected to the outer hollow housing 1 and on the other end to the surface of the internal movable body 3, the adjustment of the pre tensioning section 4 and/or screw nut 5 can preset the position of the internal movable body 3 and/or pre tensioning of the shear pin, shear sleeve etc.

When the valve according to the present invention is exposed to a pressure that is breaking the shear mechanism open, the internal movable body 3 and the retainer key 6 will be forced to move forward towards the stop surface 8. When they are abutting the stop surface 8, the valve element sealing surface 9 will have moved past at least one outlet 14 in the outer hollow housing 1, thereby opening for the fluid to be injected into the production tubing to pass through the valve.

Only elements related to the invention is described and a skilled person will understand that an outer housing or internal body may be formed in one unit or be comprised of several connected elements. The device can also function the opposite way, meaning that the locking means in an open position also can break when the pressure from the production tubing is exceeding a predetermined pressure. The device should furthermore have appropriate attachment devices for attaching the valve within a process fluid stream. The skilled person will also understand that one may make several alterations and modifications to the described and shown embodiment that are within the scope of the invention as defined in the following claims.

The invention claimed is:

1. A shear open valve, for use in an offshore or onshore well bore, comprising an outer hollow housing with an interior valve seat and an internal body comprising a valve element sealing surface, said internal body being movable in a longitudinal direction within the outer hollow housing, wherein a pre tensioning section is connected to one end of the outer housing, thereby forming a nose of the outer hollow housing, said pre tensioning section comprising a partial threaded recess and a through-going bore, into which partial threaded recess a screw nut is screwed, said screw nut comprising a through-going bore and a receiving area adapted for engaging with a locking arrangement, the through-going bore of the pre tensioning section and the through-going bore of the screw nut being aligned, the shear open valve further comprising an elongated retainer key arranged passing through the through-going bore of the screw nut, said retainer key comprising a first locking arrangement arranged to engage with the receiving area of the screw nut when the shear open valve is in a closed state, the retainer key furthermore being in contact with the internal body in the closed state of the shear open valve such that the valve element sealing surface of the internal body is in abutment with the interior valve seat of the outer housing, whereby an increase in pressure exceeding a predetermined pressure causes the first locking arrangement to disengage from the screw nut, allowing the internal movable body and the retainer key to move through the bores of the pre tensioning section and screw nut towards a stop surface in the pre tensioning section, thereby opening the shear open valve.

2. The shear open valve according to claim 1, wherein the internal body-comprises a stop surface which in a fully open position of the valve is abutting against the corresponding surface of the pre tensioning section.

3. The shear open valve according to claim 2, wherein the stop surface on the internal movable body is arranged with a hole for receiving a positioning pin arranged on the retainer key.

4. The shear open valve according to claim 3, wherein the retainer key through the positioning pin is connected to the internal body by threads or other means in order to keep the shear open valve open.

5. The shear open valve according to claim 3, wherein the retainer key is physically connected to the internal movable body by means of threads, recession, seal or adhesive.

6. The shear open valve according to claim 1, wherein the valve element sealing surface serves as a pressure surface which, when exposed to a fluid, will bias the valve towards an open position.

7. The shear open valve according to claim 1, wherein the retainer key comprises a second locking arrangement which will connect to the screw nut after the shear open valve have been opened and further keep the shear open valve open.

* * * * *